US007337779B2

(12) United States Patent
Cheng

(10) Patent No.: US 7,337,779 B2
(45) Date of Patent: Mar. 4, 2008

(54) FACEMASK TAPE-ADJUSTER

(76) Inventor: Yung-Chu Cheng, 19F-3, No. 508, Sec. 5, Chung Hsiao E. Rd., Hsin I Dist., Taipei (TW)

( * ) Notice: Subject to any disclaimer, the term of this patent is extended or adjusted under 35 U.S.C. 154(b) by 577 days.

(21) Appl. No.: 10/964,785

(22) Filed: Oct. 15, 2004

(65) Prior Publication Data

US 2005/0081337 A1 Apr. 21, 2005

(30) Foreign Application Priority Data

Oct. 16, 2003 (CN) ..... 2003 2 0100940 U

(51) Int. Cl.
*A61M 11/00* (2006.01)

(52) U.S. Cl. ..... 128/206.19; 128/206.12; 128/207.11

(58) Field of Classification Search ..... 128/206.19, 128/206.12, 206.13, 206.27, 207.11, 207.17, 128/204.11, 206.15, 205.25; 24/68 D, 713, 24/71 R See application file for complete search history.

(56) References Cited

U.S. PATENT DOCUMENTS 5,181,280 A * 1/1993 Zachry, Jr. ..... 2/452
5,205,021 A * 4/1993 Durand ..... 24/163 R
5,233,978 A * 8/1993 Callaway ..... 128/205.25
6,665,913 B2 * 12/2003 Kosh et al. ..... 24/193
7,121,122 B2 * 10/2006 Levi ..... 70/18
7,185,653 B2 * 3/2007 Lee ..... 128/206.19

* cited by examiner

*Primary Examiner*—Steven O. Douglas
(74) *Attorney, Agent, or Firm*—Rosenberg, Klein & Lee

(57) ABSTRACT

The facemask tape-adjuster is an adjusting device for the tapes of facemasks comprising of a upper piece and a lower piece respectively made joint at one edge, in which the inner face of upper piece is made to have pressing region complementary to that which is made on the inner face of bottom piece, which are further mounted between by a two-stage buckling structure, wherein opposing two of four tapes are held between the complementary inner faces reverse-overlapped through opposing ends of the adjuster, which upon first clipping stage there is space given between the two piece allowing the two tapes limited mobility for adjustment, which further upon second clipping stage the space is minimized to such that the two tapes become held fixed.

8 Claims, 8 Drawing Sheets

FACEMASK TAPE-ADJUSTER

BACKGROUND OF THE INVENTION

1. Field of the Invention

The present invention relates to adjusting devices for facemasks, but more particularly, it is an adjusting device that allows tying degrees for the tapes of facemasks to be adjustable.

2. Description of Related Art

When medical personnel are treating patients, suitable protection tools are necessary guard against infection by viruses and bacteria, while providing safer environment for patients. Among these, a mask is most basic and most popular of the protection tools. For example, a doctor in surgery must wear a mask throughout the whole operation in conforming with medical standards.

A conventional mask is worn by tying the each corresponding two of the four tapes of the facemask behind the head of the user.

However, because the doctor has to wear the facemask before the operation starts, tying is not suitable, as it can be too tight, too loose, or at an angle, which ultimately has to be untied and retied again. Furthermore, during the operation, the tapes might be loosened owing to the curved surface of the head, and therefore need to be readjusted. However, because the hands of the doctor have to stay sterile, another medical personnel will have to release and retie the tapes. This is inconvenient and time-consuming.

Thus, it can be seen that the wearing method of conventional facemasks described above is inconvenient, and that there are defects to be improved.

Consequently, because of technical defects as described above, the applicant has carved unflaggingly through wholehearted experience and research to develop the present invention, which can effectively improve on the shortcoming described above.

SUMMARY OF THE INVENTION

The object of the present invention is to provide an adjusting device for the tapes of facemasks so that the tapes can quickly and easily be held fixed or loosened, making it easily adjustable so as to facilitate the usage and increase the comfort.

For achieving the objective described above, the present invention provides the tape-adjuster for the tapes of facemasks, comprising of a upper piece and a lower piece respectively made joint at one edge, in which the inner face of upper piece is made to have pressing region complementary to that which is made on the inner face of bottom piece, which are further mounted between by a two-stage buckling structure, wherein opposing two of four tapes are held between the complementary inner faces reverse-overlapped through opposing ends of the adjuster, which upon first clipping stage there is space given between the two piece allowing the two tapes limited mobility for adjustment, which further upon second clipping stage the space is minimized to such that the two tapes become held fixed.

BRIEF DESCRIPTION OF THE DRAWINGS

FIG. 4 is a cross-sectional view showing the first stage of the buckling structure, which clips two overlapped tapes, of the tape-adjuster according to the present invention as;

DETAILED DESCRIPTION OF THE PREFERRED EMBODIMENTS

Figure 1:
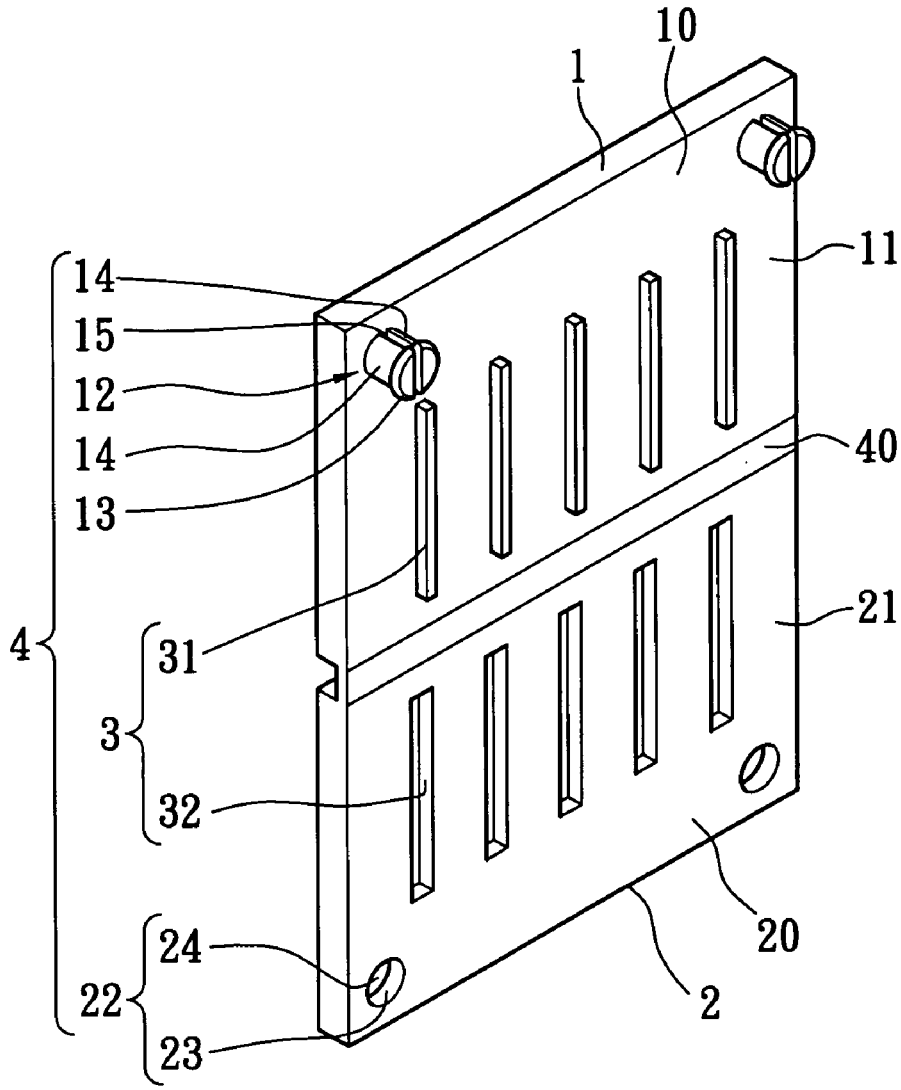
FIG. 1 is a three-dimensional drawing showing the tape-adjuster according to the present invention when unfolded.
Figure 2:
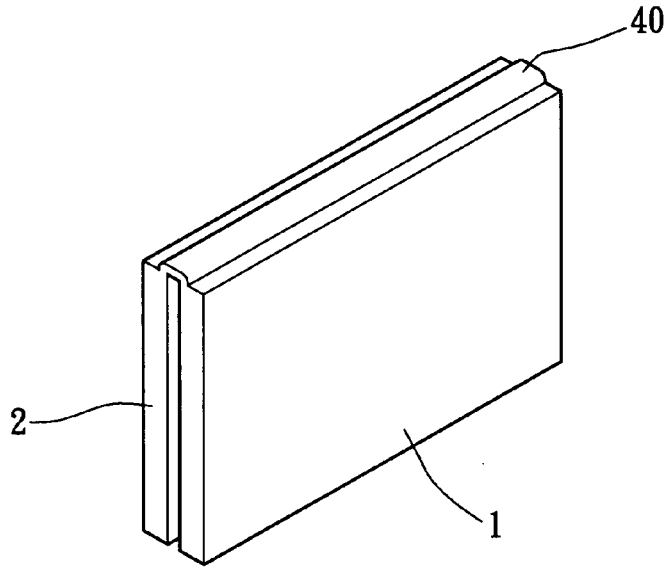
FIG. 2 is a three-dimensional drawing showing the tape-adjuster according to the present invention when clipped.
Figure 3:
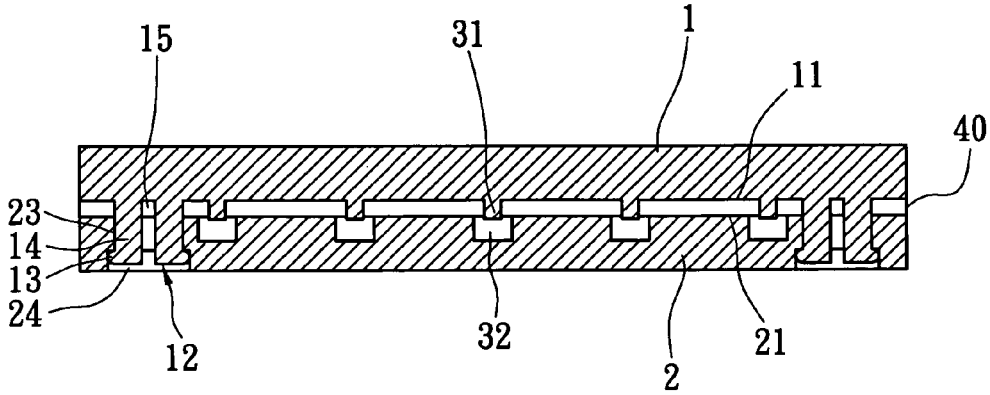
FIG. 3 is a cross-sectional view showing the tape-adjuster according to the present invention when clipped.

Now the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

By referring to FIGS. 1 to 3 and FIG. 9, in using the tape-adjuster as according to the present invention, two tapes 51, 52 in which two of the four tape ends are respectively fixed on both sides of a mask 5 and the other ends thereof are overlapped and clipped fixed by adjuster, the adjuster includes an upper piece 1, a lower piece 2, a pressing structure 3 and a two-stage buckling structure 4. In addition, the upper piece 1 has a first inner face 10 and the lower piece 2 has a second inner face 20, and one edge of the upper piece 1 and one edge of the lower piece 2 are joined together to form a joint line 40. In this preferred embodiment, the upper piece 1 and the lower piece 2 are integrally formed with the joint line 40, which is in form of an elastic ligament having thickness less than that of the upper piece 1 and the lower piece 2. Alternatively, the upper piece 1 and the lower piece 2 can also be formed separately but with pivoting holes (not shown) for a pivot (not shown), so as to form the joint line 40 analogously. In addition, the first inner face 10 and the second inner face 20 have pressing regions 11, 12 respectively for oppositely clipping the two overlapped tapes 51, 52.

Furthermore, the pressing structure 3 is mounted on the pressing regions 11, 12 of the first inner face 10 and the second inner face 20. In this preferred embodiment, the pressing structure 3 is a concave-convex matched structure comprising protrusion portions 31 and indentation portions 32, which are strip-like, arranged and mounted on the first inner face 10 and the second inner face 20 respectively and oppositely. A width and a depth of the indentation portion 32 cling on the two overlapped tapes 51, 52 and are larger than those of the protrusion portion 31.

The two-stage buckling structure 4 is mounted between the upper piece 1 and the lower piece 2. In this preferred embodiment, the two-stage buckling structure 4 is mounted between the first inner face 10 and the second inner face 20, located at the sides of the upper piece 1 and the lower piece 2 opposite the joint line 40. The two-stage buckling structure 4 can connect the edge opposite the joint edge of the upper piece 1 and the lower piece 2.

Figure 4:
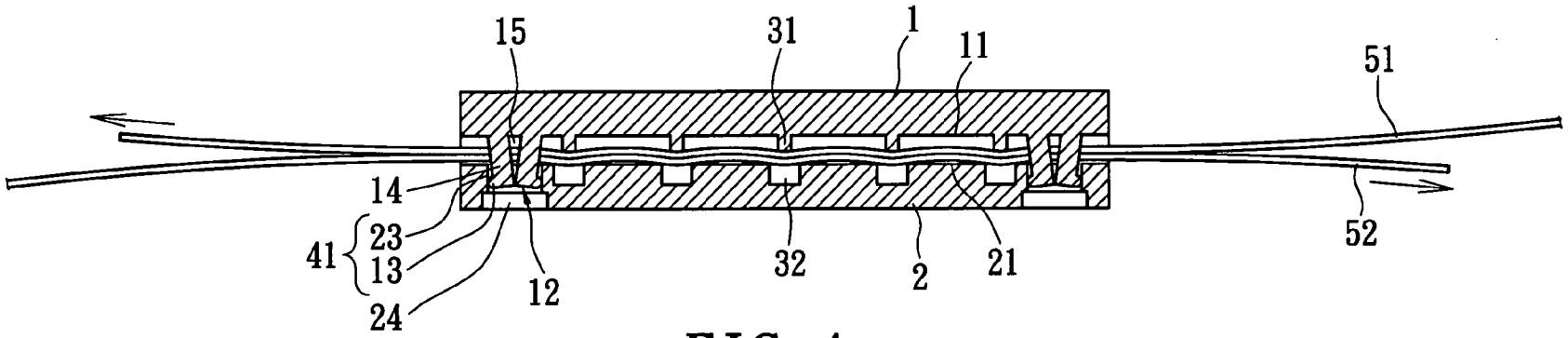
Figure 5:
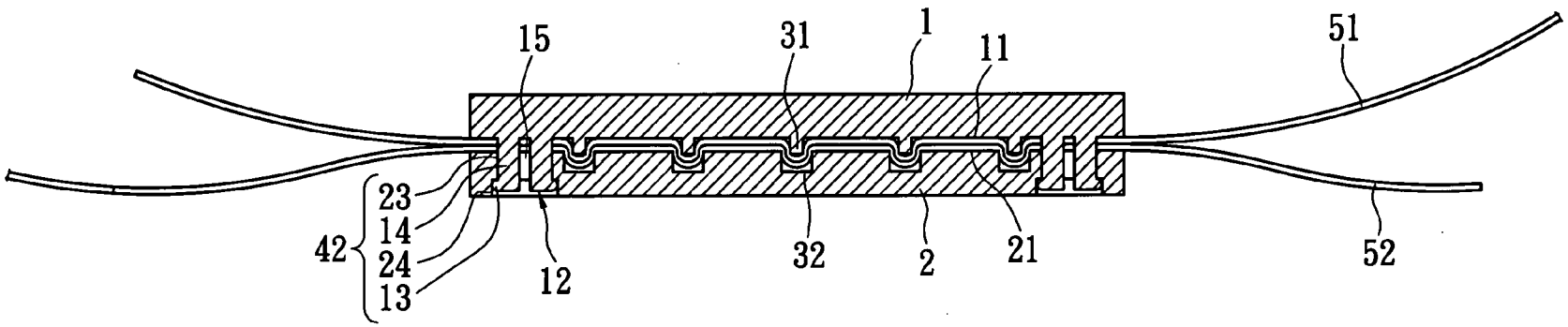
FIG. 5 is a cross-sectional view showing a the second stage of the buckling structure, which clips two overlapped tapes, of the tape-adjuster according to the present invention.

Please refer to FIGS. 4 and 5. The two-stage buckling structure 4 further comprises a first stage structure 41 and a second stage structure 42. The first stage structure 41 is employed to clamp the first inner face 10 and the second inner face 20 together, while leaving space between the pressing regions 11, 21 for the two overlapped tapes 51, 52 to be movable. Then, the second stage structure 42 is used to fasten the first inner face 10 and the second inner face 20, together reducing the space between the pressing regions so that the two overlapped tapes 51, 52 can be clipped fixed.

In this preferred embodiment, the two-stage buckling structure 4 has the positioned posts 12 mounted on the first inner face 10 and positioned holes 22 mounted on the second inner face 20, wherein the free end of the positioned post 12 has a protruding edge 13 with an arc-guiding angle, and a cutting trench 15, forming two opposite elastic arms 14. The positioned hole 22 has a neck portion 23 with a smaller outer diameter and a chamber 24 with a larger outer diameter. The combining structure 41 is that the two opposite elastic arms 14 are introverted, and the protruding edge 13 of the positioning post 12 can be slid against the inner wall of the neck portion 23 cooperatively. Then, the buckling structure's 42 outer wall of the positioned post 12 is fitted with the inner wall of the neck portion 23, and the protruding edge 13 of the positioned post 12 is fitted with the inner wall of the chamber 24.

According tape-adjuster of the present invention, when the user intends to wear the mask 5, the two tapes 51, 52 on each side of the mask 5 should first be overlapped. Then the pressing regions 11, 21 of the upper piece 1 and the lower piece 2 can clip the two overlapped tapes 51, 52 in two stages. In the first stage, the positioned post 12 should be plugged into the positioned hole 22 correspondingly, and because the two opposite elastic arms 14 must be introverted through the arc guiding angle of the protruding edge 13, the protruding edge 13 of the positioned post 12 can be smoothly and conveniently inserted into the neck portion 23 of the positioned hole 22. At this time, because the protruding edge 13 can cling against the inner wall of the neck portion 23, the buckling structure 41 will only clip the first inner face 10 and the second inner face 20 together but with a space between the pressing regions 11, 21. Thus the two overlapped tapes 51, 52 are confined by the space, but still easily pulled for adjusting. When the tapes are adjusted to a comfortable position, the protruding edge 13 of the positioned post 12 can now be inserted further into the chamber 24 of the positioned hole 22, and the outer wall of the positioned post 12 will slide against the inner wall of the neck portion 23. At this time, because the two opposite elastic arms 14 are returned to their original positions, the protruding edge 13 of the positioned post 12 is accommodated into the chamber 24, and the buckling structure 42 will fastened the first inner face 10 and the second inner face 20 tightly reducing the space between the pressing regions 11, 21, thus clipped the two overlapped tapes 51, 52 fixed. At this point, the wearing of the mask is completed. If the tapes 51, 52 are loose owing to the curved surface of the head during operation, the wearer only needs to pull the tapes 51, 52. Further, the pressing structure 3 will easily be released thereby so as to release the buckling structure 42. At this time, through the arc-guiding angle of the protruding edge 13, the positioned post 12 will be slid out of the chamber 24 so as to return to the larger space between the pressing regions 11, 21. Likewise, the protruding edge 13 will cling against the neck portion 23 so the two tapes 51, 52 can once again be limitedly moved inside the space. After the adjusting is completed, the buckling structure 42 may once again fasten the first and the second inner faces together. When surgery is finished, the user needs only to unclamp the first inner face 1 and the second inner face 2, and the mask 5 is easily taken off.

Figure 6:
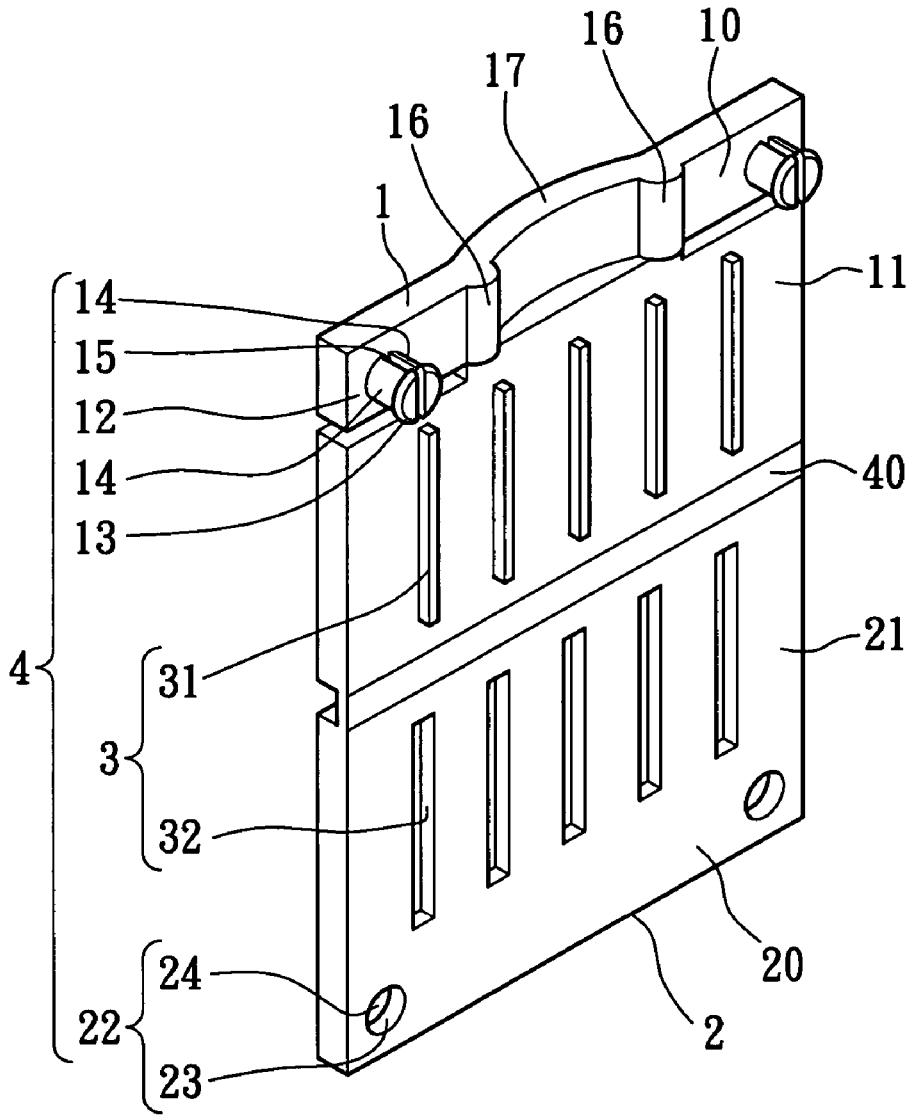
FIG. 6 is a three-dimensional drawing showing an arc piece mounted on the tape-adjuster according to the present invention.
Figure 7:
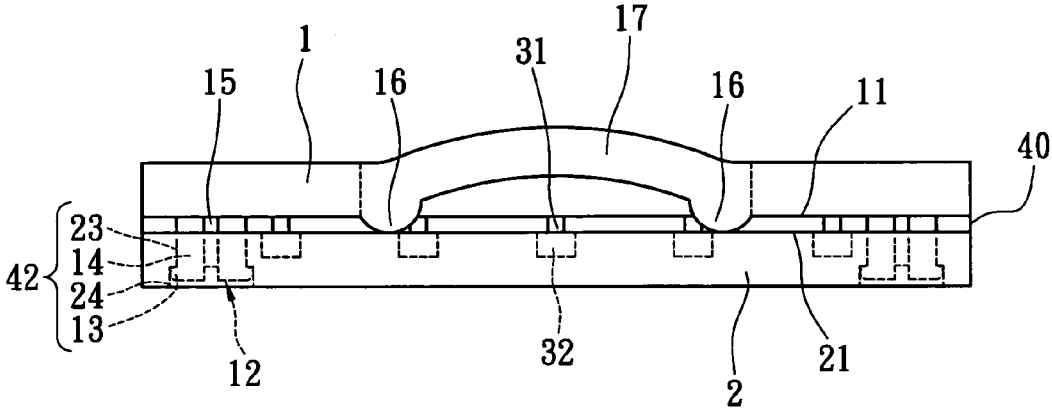
FIG. 7 is a side view showing the tape-adjuster with an arc piece mounted thereon according to the present invention before being pressed down.
Figure 8:
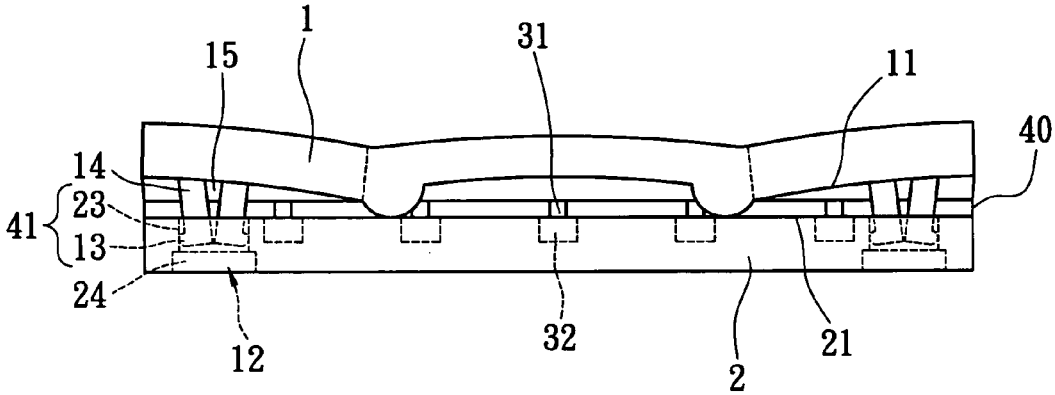
FIG. 8 is a side view showing the tape-adjuster with an arc piece mounted thereon according to the present invention as being pressed down.
Figure 9:
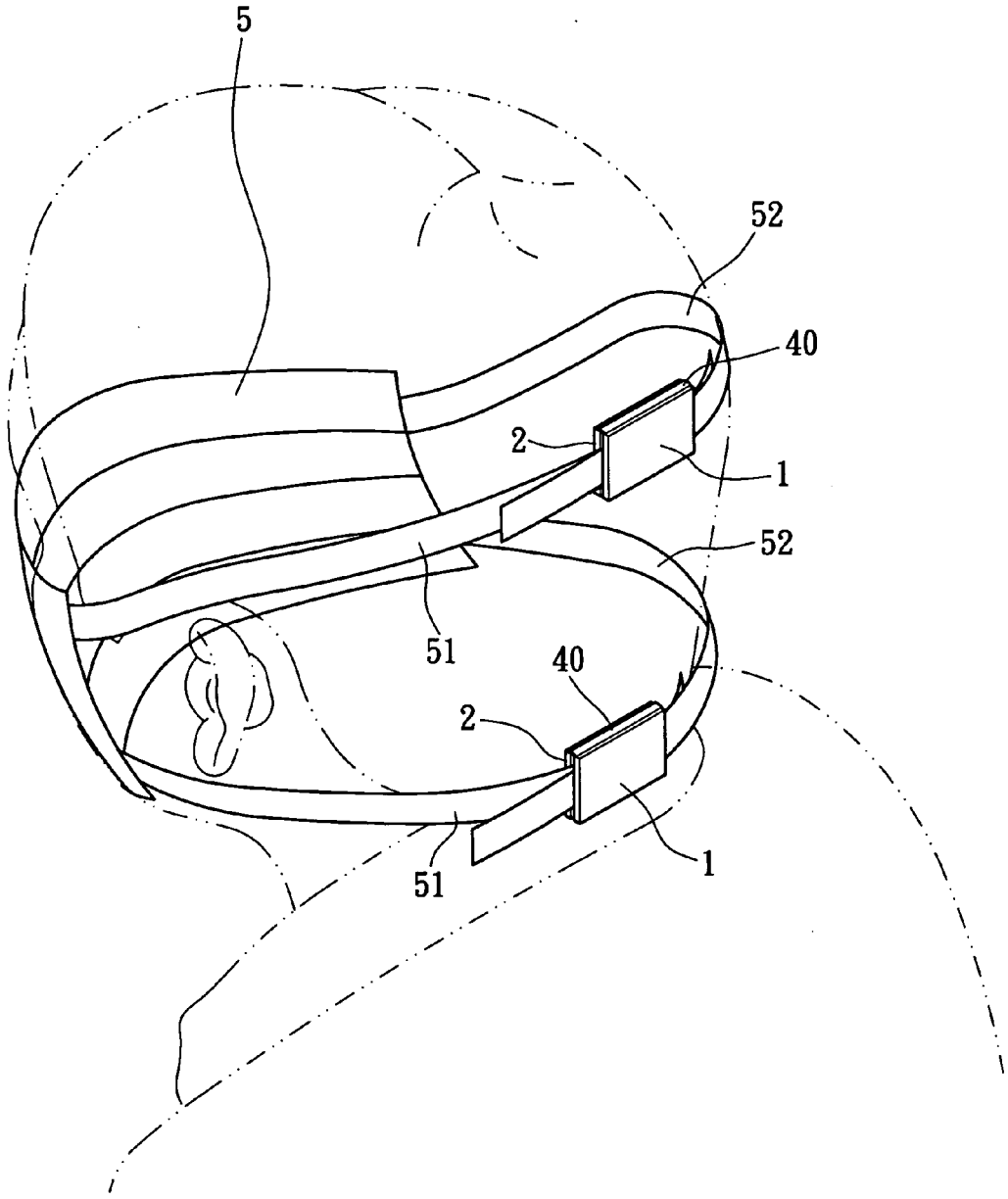
FIG. 9 is a schematic view showing the operation state of the tape-adjuster according to the present invention.

By referring to FIGS. 6 to 8, the upper piece 10 can further comprise an arc piece 17 protruding outwardly and two rejecting blocks 16 mounted on two ends of the arc piece 17, which protrude inwardly to contact the second inner face 20. When the two tapes 51, 52 are clipped fixed between the first inner face 10 and the second inner face 20, the tying degree can be adjusted by the user by pressing the arc piece 17. Through an elastic deformation, the rejecting blocks 16 will be slightly moved outwardly so as to release the first inner face 10 from the second inner face 20. At this time, because the two tapes 51, 52 are only limited by the combining structure 41, they can be readjusted.

Figure 10:
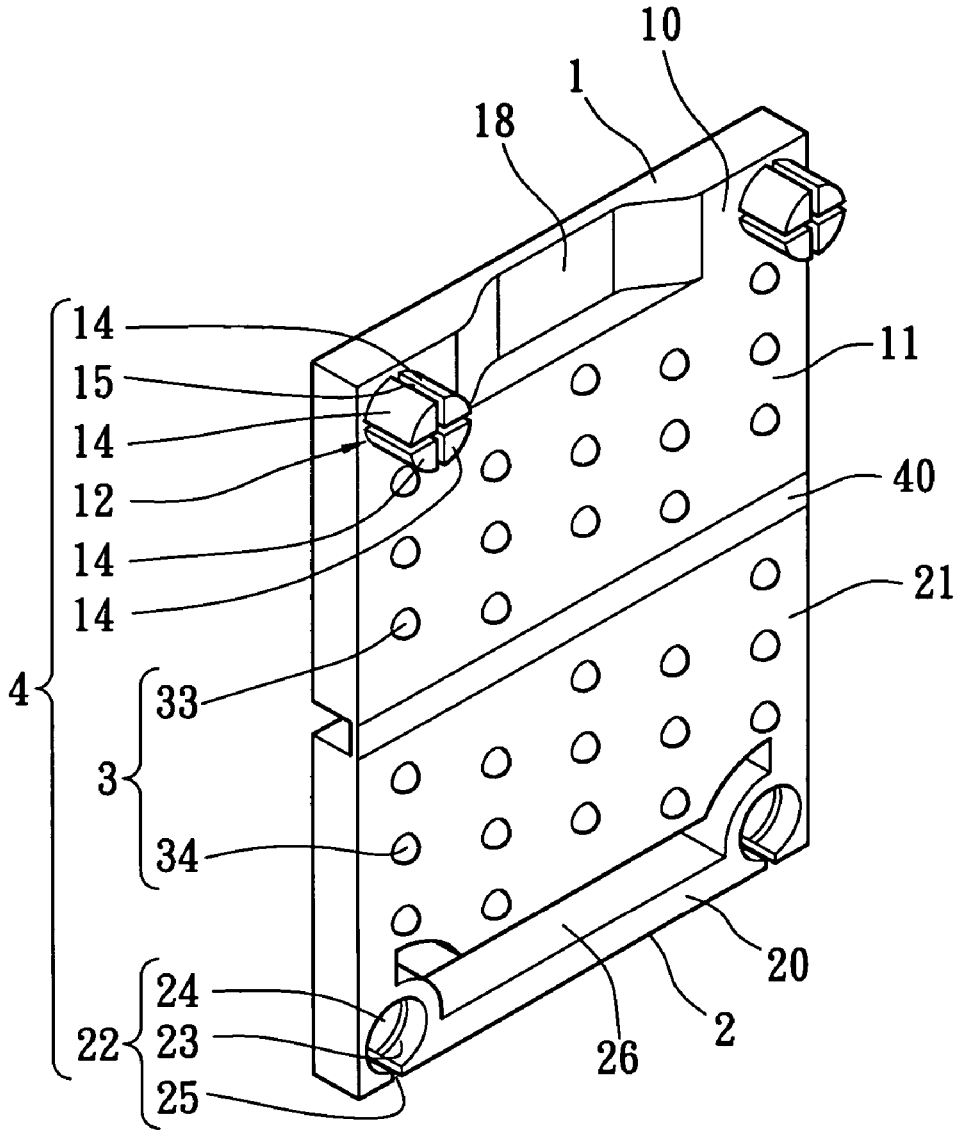
FIG. 10 is a three-dimensional drawing showing the tape-adjuster having a liftable piece mounted thereon according to the present invention.
Figure 11:
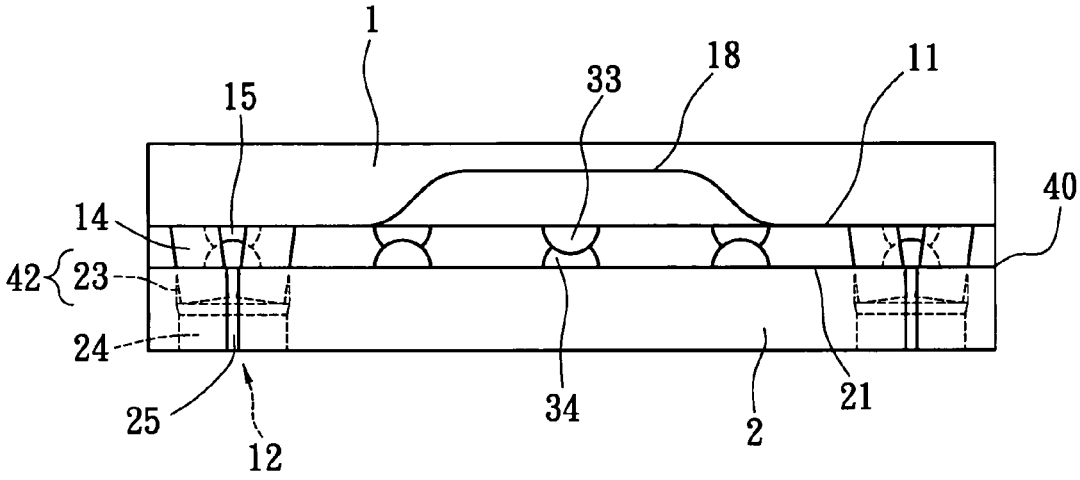
FIG. 11 is a side view showing the tape-adjuster with a liftable piece, which is lifted up, according to the present invention.

Referring to FIGS. 10 and 11, this embodiment's two-stage buckling structure 4 has the positioned post 12 mounted on the first inner face 10 and the positioned hole 22 on the second inner face 20, wherein the positioned post 12 comprises at least a cutting trench 15 so as to form two opposite elastic arms 14. The positioning hole 22 on the other hand has a neck portion 23 with a smaller outer diameter, and a chamber 24 with a larger outer diameter. Furthermore, an extending slot 25 is mounted on the outer edges of the lower piece 2 and an opening 26 is mounted on the second inner face 20 so that an arc thin-wall might be formed between the positioned hole 22 and the opening 26, thus a preferable buckling performance can be achieved between the positioned post 12 and the positioned hole 22. In addition, the pressing structure 3 comprises a first protruding portion 33 and a second protruding portion 34 arranged in a hemispherical shape, correspondingly mounted respectively on the first inner face 10 and the second inner face 20, wherein the first protruding portion 33 and the second protruding portion 34 are pressed together in an alternate manner. Other than that, the upper piece 1 may further comprise a liftable piece 18 so that, if the tying degree is needed to be readjusted, it only needs to be lifted by the liftable piece 18 to release the buckling structure 42 of fastening, making readjusting easily performed.

Consequently, the tape-adjuster according to the present invention is advantageous in that:

1. The two overlapped tapes of the mask are positioned between the pressing regions of the first inner face and the second inner face, such that when the first inner face and the second inner face clips together, the two-stage buckling structure fastens while allowing some space to formed between the pressing regions, so as to allow some mobility to the overlapped tapes for adjustment.

2. The two-stage buckling structure is employed to fasten the first and the second inner faces and to reduce the space between the pressing regions, so that the two overlapped tapes can be clipped fixed there between.

3. When the buckling structure is released, the first and the second inner faces can still be clipped together to providing easy adjusting for the tapes, quick fixing and releasing, in all making wearing the mask simpler and more comfortable.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. The facemask tape-adjuster comprising of a upper piece and a lower piece respectively joined at one edge defining a joint line in which a first inner face of said upper piece is made to have pressing region complementary to that which is made on a second inner face of said bottom piece, which are further mounted between by a two-stage buckling structure, wherein opposing two of four tapes are held between the complementary inner faces reverse-overlapped through opposing ends of the adjuster, which upon first clipping stage there is space given between the two said piece allowing the two said tapes limited mobility for adjustment, which further upon second clipping stage the said space is minimized to such that the two said tapes become held fixed.

2. The tape-adjuster according to claim 1, wherein said two-stage buckling structure is located at the side edges opposite the said joint line.

3. The tape-adjuster according to claim 1, wherein said two-stage buckling structure is mounted between said first inner face and said second inner face.

4. The tape-adjuster according to claim 3, wherein said two-stage buckling structure is a positioned post mounted on said first inner face and a positioned hole mounted on said second inner face, wherein said positioned post comprises a protruding edge with a free end thereof, which has an arc guiding angle and a cutting trench, which forms two opposite elastic arms, and said positioned hole has a neck portion with a relatively smaller outer diameter and a chamber with relatively larger outer diameter, wherein for first clipping stage of the buckling structure, the said two opposite elastic arms are introverted and said protruding edge of said positioned post clings against the inner wall of said neck portion, which further upon said second clipping stage, the outer wall of said positioned post fits with said inner wall of said neck portion and said protruding edge of said positioning post, with the said post completely fit into said hole.

5. The tape-adjuster according to claim 1, wherein said upper piece further comprises an arc piece protruding outwardly rejecting blocks mounted on two ends of said arc piece, and protruding inwardly to contact said second inner face.

6. The tape-adjuster according to claim 1, 2, 3, 4 or 5, further comprises a pressing structure mounted on said pressing region of said first inner face and said second inner face.

7. The tape-adjuster according to claim 6, wherein said pressing structure is a concave-convex matched structure comprising a protrusion portion and an indentation portion, which are respectively and correspondingly mounted on said first inner face and said second inner face, wherein a width and a depth of said indentation portion fit said two overlapped tapes, and are relatively larger than those of said protrusion portion.

8. The tape-adjuster according to claim 1, wherein said upper piece and said lower piece are integrally formed with said joint line, which is in form of an elastic ligament, having thickness relatively less than that of said upper piece and said lower piece.

* * * * *